US005453586A

United States Patent [19]

Stottmann

[11] Patent Number: 5,453,586

[45] Date of Patent: Sep. 26, 1995

[54] APPLIANCE CONTROL PANEL ASSEMBLY

[75] Inventor: Richard L. Stottmann, Harrods Creek, Ky.

[73] Assignee: General Electric Company, Louisville, Ky.

[21] Appl. No.: 173,897

[22] Filed: Dec. 27, 1993

[51] Int. Cl.[6] ..... H01H 13/06

[52] U.S. Cl. ..... 200/5 R; 200/302.2

[58] Field of Search ..... 200/5 R, 5 A, 200/18, 511, 512, 517, 293, 295, 302.1, 302.2, 332.1, 333, 341, 344, 345

[56] References Cited

U.S. PATENT DOCUMENTS

| | | | |
|---|---|---|---|
| 3,978,297 | 8/1976 | Lynn et al. | 200/5 A |
| 4,065,649 | 12/1977 | Carter et al. | 200/5 A |
| 4,203,013 | 5/1980 | Serras-Paulet | 200/5 A |
| 4,249,054 | 2/1981 | Komaki | 200/159 B |
| 4,263,485 | 4/1981 | Corwin | 200/5 A |
| 4,559,427 | 12/1985 | Dolson et al. | 200/5 A |
| 4,620,075 | 10/1986 | La Belle et al. | 200/159 B |
| 4,644,326 | 2/1987 | Villalobos et al. | 340/365 R |
| 4,788,447 | 11/1988 | Kiyono et al. | 307/10 R |
| 4,791,258 | 12/1988 | Youtz et al. | 200/302.1 |
| 5,225,818 | 7/1993 | Lee et al. | 340/711 |

*Primary Examiner*—Kristine L. Kincaid
*Assistant Examiner*—Michael A. Friedhofer
*Attorney, Agent, or Firm*—H. Neil Houser

[57] ABSTRACT

A dishwasher control panel assembly includes an escutcheon which supports various controls. A switch mechanism is mounted on the inside of the escutcheon and the push buttons extend through a slot in the escutcheon. A liner overlies the outside of the escutcheon and the push buttons extend through a corresponding slot in the liner. A thin, flexible cover overlies the liner and has an outwardly projecting touch pad aligned with each push button. In their extended positions the push buttons bias the touch pads outwardly and the cover is sufficiently flexible for the touch pads to move inwardly enough to depress the push buttons.

12 Claims, 2 Drawing Sheets

APPLIANCE CONTROL PANEL ASSEMBLY

BACKGROUND OF THE INVENTION

The present invention relates to control panel assemblies for appliances. More particularly it relates to an improved control panel assembly which provides many of the advantages of capacitive touch or similar switches while using mechanical push button switches.

The advent of electronic controls has resulted in many improvements in appliances, including improvements in the control panels for appliances. "Electronic switches", such as capacitive touch or similar switches or contacts, can be used with such controls. They enable the manufacturer to use a smooth, uninterrupted cover on the control panel. This is visually pleasing and enhances the cleanability of the panel. However, it has several disadvantages. One disadvantage is that such switches are significantly more costly than the well known mechanical push button switches which have been used in appliance controls for many years. Also most manufacturers have a number of different models in each line of appliances and many of the individual models do not include electronic controls. The use of electronic switches with some models and mechanical switches with other models causes unwanted differences in the appearance between different models and requires the added expense of simultaneously using two significantly different control panel assemblies.

It is an object of this invention to provide an improved control panel assembly for appliances.

It is another object of this invention to provide such an improved assembly in which touch pads integral with the cover are used to actuate the push buttons of mechanical switches.

SUMMARY OF THE INVENTION

In accordance with one embodiment of the present invention a control panel assembly for an appliance includes an escutcheon to support various appliance controls. The escutcheon includes an elongated slot to receive a row of push button type switch actuators. A switch assembly includes a plurality of push buttons arranged in a row. The assembly is mounted on the inside of the escutcheon with the push buttons extending through the slot. A liner is mounted on the outside of the escutcheon and includes an elongated slot aligned with the slot in the escutcheon. The push buttons extend through the slot in the liner. A thin flexible cover is mounted on the outside of the liner and includes a plurality of touch pads aligned with corresponding push buttons. When in their extended positions, the push buttons engage the inner side of the cover and bias the touch pads outward. The cover is sufficiently flexible that the touch pads can be depressed to actuate the push button switches.

BRIEF DESCRIPTION OF THE DRAWINGS

While the features of the invention presently considered to be novel are set forth in the appended claims; the invention, both as to organization and content, will be better understood and appreciated from the following detailed description, taken in conjunction with the drawings, in which:

DETAILED DESCRIPTION OF PREFERRED EMBODIMENT

Figure 1:
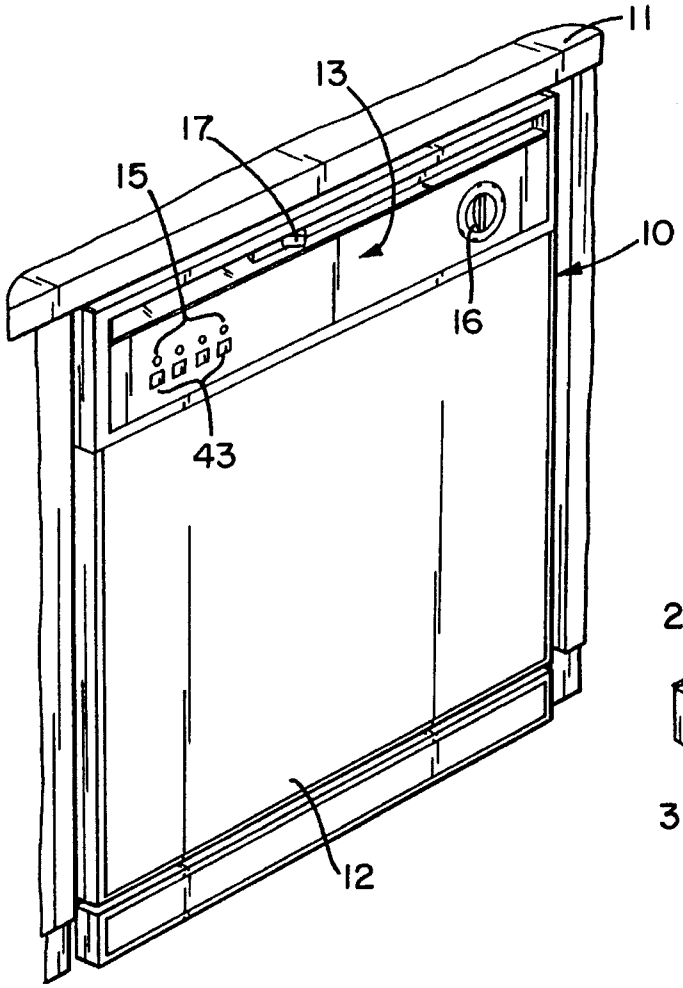
FIG. 1 is a front perspective view of a built-in dishwasher, illustrating the placement of the control panel assembly.

Referring now to FIG. 1, there is illustrated a dishwasher 10 built into a kitchen cabinet unit 11. More particularly, the dishwasher door 12 includes an integral control panel assembly 13 which includes push-button actuating touch pads 43, indicator lights 15 and a control knob 16. The touch pads 43 and control knob 16 are used to select the desired cycle of operation and other operating parameters. The signal lights inform the user what options have been selected and, in some instances, at what point the machine is in its cycle of operation. A handle 17 extending through the upper portion of the control panel is used to selectively lock the door in its closed position so that it will not inadvertently be opened while the machine is operating.

Figure 2:
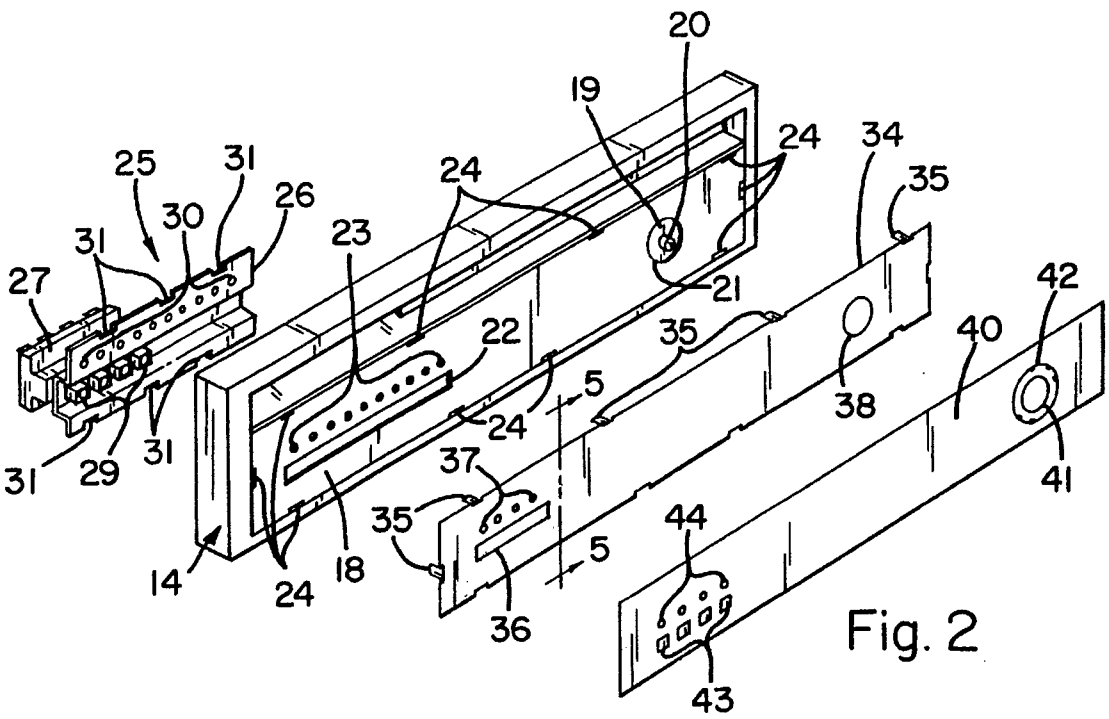
FIG. 2 is a partial exploded view of major components of the control panel assembly of FIG. 1.

FIG. 2 illustrates, in somewhat simplified form, the major components of the control panel assembly 13. An escutcheon 14, formed of a suitable molded plastic material, is an integral component of the door assembly 12 and provides support for the other components of the control panel. The escutcheon 14 includes a planar base plate 18. A rotary control 19 is mounted on the inside of the escutcheon and includes an operating shaft 20 projecting through a circular opening 21 in the plate 18. The control knob 16 mounts on the shaft 20 to set the rotary control. An elongated slot 22 extends laterally across the plate 18 and a number of small openings 23 are positioned above the slot. As will be explained in more detail hereafter, push buttons of a push button type mechanical switch assembly extend through the slot 22 and the openings 23 permit the passage of light from indicator lamps to show which individual push buttons are actuated. Finally, a number of small openings or slits 24 are spaced apart around the periphery of the plate 18.

A mechanical switch assembly 25 includes a mounting bracket 26 which supports a switch slide and contact module 27. Push rods 28 (see FIG. 4) extend from the module 27 and are selectively actuated by push buttons 29. It will be understood that push button type switch assemblies have been well known in the art for many years. In such assemblies depressing a push button actuates one or more selected contact pairs. When one button and rod are depressed the rod moves slides in the module to releasable lock that rod and button pair in its depressed position and normally force at least one previously actuated rod and button pair outward. In addition many such switch assemblies include springs which bias the individual rods 28 and associated buttons 29 outward to their extended positions.

It will be noted in FIG. 2 that there are only four push buttons 29, arranged in a row laterally across the frame 26 and that the row of buttons 29 is much shorter than the slot 22 in escutcheon plate 18. The escutcheon is molded to accommodate the controls for the most highly featured dishwasher in a line of dishwashers. Dishwashers, like the illustrative example, are not as highly featured and do not include as many push button switches.

Figure 4:
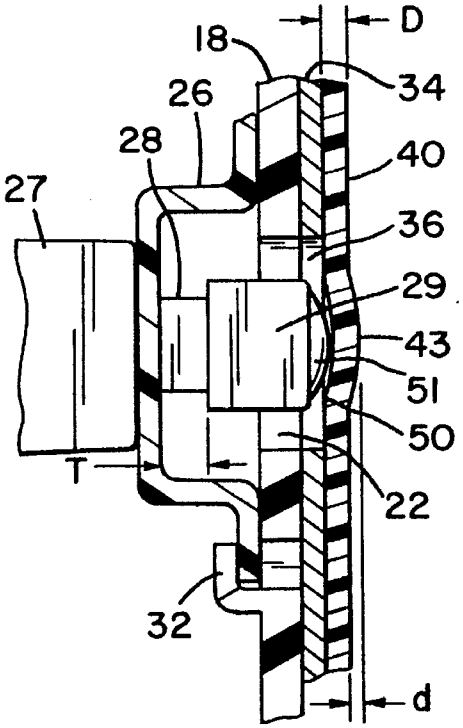
FIG. 4 is a fragmentary cross section view of the control panel assembly illustrating the interrelationship of various components, including a push button in its extended position.

Small openings 30 in the top of the switch frame 26 align with the openings 23 in plate 18 for the passage of light from indicator lamps. The indicator lamps do not form part of this invention and have been omitted for the sake of simplicity. The frame 26 includes recesses 31 spaced apart along its upper and lower edges. The inner side of escutcheon base plate 18 includes corresponding spaced apart tabs 32 (see FIG. 4). The switch assembly 25 is mounted on the escutcheon by inserting the tabs 32 through corresponding recesses 31 in the switch frame 26 and then moving the frame laterally to bring the tabs and frame into interfering relationship. As seen in FIG. 4, the tabs 32 and the plate 18 fit closely adjacent each side of the frame 26 so that the switch assembly is held tightly against the plate 18.

The construction and operation of push button actuated switches is well known in the art. Therefore the details of the switch assembly 25 have been omitted for the sake of simplicity. By way of example only, a four button switch assembly sold by General Electric Company as Model No. ASP 10136, was incorporated in the illustrative control assembly.

Figure 5:
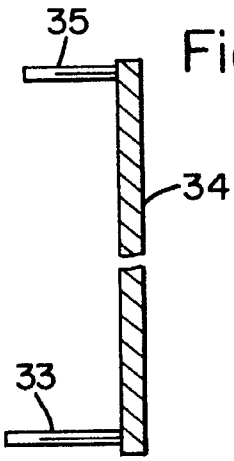
FIG. 5 is a cross section view of the liner of FIG. 1.
Figure 3:
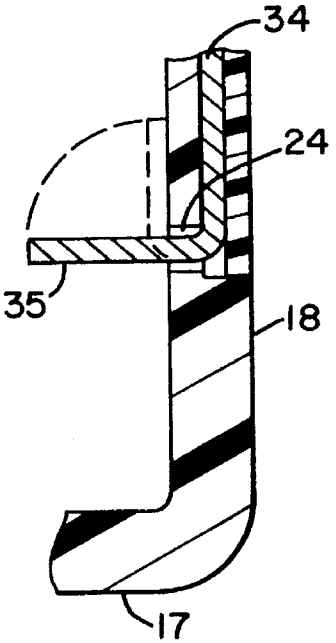
FIG. 3 is a fragmentary cross section view of the control panel assembly illustrating the manner in which the liner is mounted on the escutcheon.

A substantially rectangular liner 34 has the same planar dimensions as the escutcheon plate 18 and includes a plurality of tabs, such as those shown at 35, which are spaced apart around the periphery of the liner with positions and spacings corresponding to those of the slits 24 in the plate 18. Prior to assembly of the liner to the escutcheon the tabs are perpendicular to the plane of liner 34, as seen in FIG. 2. The liner is mounted on the outer surface or side of the escutcheon plate 18 by inserting the tabs 35 through corresponding slits 24 and then bending the tabs so that they overlie the reverse or inner side of the plate 18 (see FIG. 3). Preferably the tabs are not bent so far as to draw the liner tightly against the escutcheon. Rather the liner is provided with a small amount of "play" or "give" perpendicular to the plate 18. The distal ends of the tabs are rounded, as seen in FIG. 2, and the tabs on one side of the liner are longer than the tabs on the other side. For example, it will be seen in FIG. 5 that the tabs 33 on the bottom of liner 34 are longer than the tabs 35 on the top of the liner. This greatly enhances the ease and speed with which the liner is mounted on the escutcheon. As shown in FIG. 2, the tabs are formed so that their bases are within the outer peripheral edge of the liner 34. More particularly, when the tabs are bent over to mount the liner to the escutcheon, the junctions of the tabs and liner will be within the peripheral edge of the liner 34.

The liner 34 includes a laterally extending slot 36 which is aligned with a portion of the slot 22 in escutcheon 17. More particularly the slot 36 is aligned with and long enough to accommodate the push buttons 29. In addition openings 37 in liner 34 align with the openings 31 in switch frame 25 and openings 23 in plate 18 corresponding to the push buttons 29. An opening 38 is provided near the other end of liner 34 to accommodate the shaft 20. The liner is preferably constructed from some thin but sturdy and opaque material. In the illustrative embodiment the liner is made of aluminum. In addition, the liner for a particular machine is provided with only those openings needed for the controls, push buttons and rotary switches for example, and corresponding signal lights used on that machine. The liner effectively masks any other openings in the escutcheon plate 18. This enables a single set of molds to be used to manufacture escutcheon base plates for a number of different machines.

The control panel assembly also includes a thin, flexible cover 40 formed as a sheet of a plastic material. In the illustrative embodiment the cover is made of a polycarbonate. However, other materials, such as polypropylene and Mylar for example, could be used. The cover 40 includes an opening 42 through which the shaft 20 extends to receive the knob 16. The essentially uninterrupted surface of cover 40 enhances it cleanability and to that end the cover 40 preferably is clear and various graphics are applied to its rear, as indicated by the ring 42 around opening 41. The cover 40 includes four touch pads 43 which are formed to extend outwardly of the cover away from the liner 34. Each touch pad 43 is aligned with a corresponding push button 29.

Figure 6:
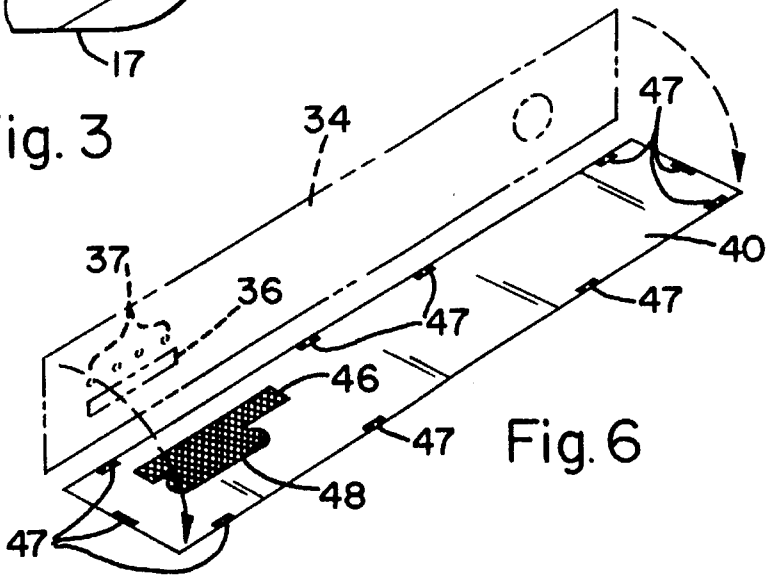
FIG. 6 is a simplified exploded view of the liner and cover of the control panel assembly of FIG. 1.

The cover 40 is generally rectangular and is at least as large as the liner 34 so that, when the cover is mounted over the liner, it completely covers the liner, including the junctions of the tabs 33, 35. The cover 40 is mounted to the outer surface or side of the liner 34 by use of a suitable adhesive, for example a contact adhesive. As indicated in FIG. 6 by the large cross hatched area 46 and the small cross hatched areas 47, the adhesive is omitted from or neutralized in the area around the touch pads 43 and push buttons 29 and from the areas of the cover which overlie the junction of the tabs 33, 35 and liner 34. The omission or neutralization of adhesive from area 46 enhances the flexibility of cover 40 and particularly the flexibility of touch pads 43. As indicated by the bulge 48 in area 46, the adhesive is also omitted from the area aligned with signal light openings 37 in liner 34. The omission of adhesive from areas 47 overlying the junctions of the tabs 33, 35 with liner 34 reduces the transfer of force from the liner/escutcheon connection to the cover 40.

When the user desires to actuate a particular switch she/he depresses the appropriate pad 43 sufficiently to move the corresponding push button 29 and push rod 28 pair to their depressed or actuated position.

A number of factors contribute to the ease of operation of the touch pads and the long life of the assembly, particularly the cover in the area around the touch pads. First the nominal travel distance of the push buttons is minimized. For example typical appliance push button switches in the past have a design or nominal travel in the order of about 1/8-1/4 inch. The switch incorporated in the illustrative embodiment has nominal or design push button travel of about 1/16 inch, see dimension "T" in FIG. 4. As seen in FIG. 4, the touch pads are embossed to project outward of the plane of the cover 40. In the illustrative embodiment the cover sheet was about 0.015 inch thick, see dimension "D" in FIG. 4, and the embossment was about 0.012 inch, see dimension "d" in FIG. 4. I have found that with a polycarbonate cover thickness between about 0.008 inch and about 0.020 inch an embossment height of between about 0.010 and about 0.070 is acceptable. Viewing FIG. 4, the cross section shape of the touch pads 43, as shown at 50, and the distal ends of the push buttons 29, as seen at 51, are convex in the outward direction away from the escutcheon 17. This curve reduces the force needed to depress the touch pads and helps prolong the life of the area of the cover 40 around the touch pads.

Finally, as seen in FIG. 4, when in their outward positions the push buttons engage the inside of the corresponding touch pads and urge the pads outward. This assures minimum travel of the touch pads as there is no "lost motion" depression of a touch pad before it begins depressing the corresponding push button. Since the cover 40 is firmly attached to the liner 34 by adhesive the liner is also biased outward to the extent permitted by the give or play between the liner tabs 33, 35 and the escutcheon plate 18. When a touch pad is depressed, the liner can move slightly, decreasing the amount of flexure of the cover required to depress the corresponding push button/push rod pair.

While specific embodiments of the present invention have been illustrated and described herein, it is appreciated that modifications and changes will occur to those skilled in the art to which the invention pertains. It is therefore intended to cover all such modifications and changes as fall within the true spirit and scope of the invention.

What is claimed is:

1. A control panel assembly for an appliance, including:

an escutcheon adapted to support controls for said appliance and including an elongated slot to receive a row of push button switches;

a push button switch assembly including a plurality of push buttons arranged in a row, each of said push buttons having an extended position and a depressed position; said switch assembly being mounted on the inner side of said escutcheon with said row of push buttons aligned with said slot, each of said push buttons extending through said slot at least when in its extended position;

a liner mounted on the outer side of said escutcheon and including an elongated slot aligned with said escutcheon slot, each of said push buttons projecting through said liner slot at least when in its extended position;

a cover sheet mounted on the outer side of said liner and including an integral, outwardly projecting touch pad aligned with each of said push buttons; each of said push buttons, in its extended position, engaging the inner side of said cover member and biasing its associated touch pad outward; and said cover sheet being sufficiently flexible that each touch pad is sufficiently depressable to move its associated push button to its depressed position;

said escutcheon includes a plurality of spaced apart openings there through;

said liner is a sheet of metal having a plurality of projecting tabs spaced apart in a manner corresponding to said openings in said escutcheon; and said tabs are inserted through corresponding openings and bent to overlie said inner side of said escutcheon.

2. A control panel assembly as set forth in claim 1, wherein: said push buttons and said touch pads are curved convexly outward.

3. A control panel assembly as set forth in claim 1, wherein: said cover is a sheet of water impervious material.

4. A control panel assembly as set forth in claim 1, wherein: said cover is a thin, flexible sheet of plastic material.

5. A control panel assembly as set forth in claim 4, wherein: said cover sheet has a thickness of between about 0.008 inch and about 0.020 inch.

6. A control panel assembly as set forth in claim 5, wherein; each touch pad projects outward of said cover between about 0.010 inch and about 0.070 inch.

7. A control panel assembly as set forth in claim 6, wherein: each touch pad projects outwardly in the range of about 0.012 inch.

8. A control panel assembly as set forth in claim 4, wherein: said cover sheet is composed of a material selected from the group comprising polycarbonate, polypropylene and polyethelene.

9. A control panel assembly as set forth in claim 1, wherein: when said liner is fully mounted on said escutcheon, said tabs are slightly spaced from said inner side of said escutcheon so said liner can move when each touch pad is depressed to move its associated push button to its depressed position.

10. A control panel assembly as set forth in claim 1, wherein: said liner includes a generally rectangular body; said tabs are spaced apart about the periphery of said liner body; and, when said tabs are in their bent configuration, each tab is within the periphery of said liner body.

11. A control panel assembly as set forth in claim 10, wherein: said cover overlies said tabs and said liner body.

12. A control panel assembly as set forth in claim 11, wherein: said cover is mounted on the outer side of said liner with an adhesive and the area of said liner body adjacent each tab is free of adhesive.

* * * * *